United States Patent [19]

Gevers

[11] 4,377,314

[45] Mar. 22, 1983

[54] PIECE OF FURNITURE PARTICULARLY FOR STOWING GOODS AWAY, AND STOW-AWAY UNIT FORMED BY SUCH PIECES OF FURNITURE

[76] Inventor: Christophe Gevers, Chemin du Fond Coron, 27, Ohain, Belgium

[21] Appl. No.: 196,851

[22] Filed: Oct. 14, 1980

[30] Foreign Application Priority Data

Oct. 17, 1979 [BE] Belgium ..... 0/197682

[51] Int. Cl.[3] ..... E06B 9/14; E04B 1/32

[52] U.S. Cl. ..... 312/297; 312/3; 52/86; 52/222

[58] Field of Search ..... 312/297, 3, 4, 5, 6; 220/4 F; 248/453; 52/86, 222

[56] References Cited

U.S. PATENT DOCUMENTS

| | | | |
|---|---|---|---|
| 1,455,569 | 5/1923 | Caminoni, Jr. | 312/6 |
| 1,455,640 | 5/1923 | McNamara | 403/381 |
| 2,827,138 | 3/1958 | Roy, Jr. | 52/222 |
| 3,063,497 | 11/1962 | Bruecker | 52/222 |
| 3,065,574 | 11/1962 | Piana | 52/86 |
| 3,165,110 | 1/1965 | Brooks | 52/222 |
| 3,254,462 | 6/1966 | Toler | 52/222 |
| 3,364,634 | 1/1968 | Allaire | 52/222 |
| 3,465,486 | 9/1969 | Rolin | 52/222 |
| 3,679,280 | 7/1972 | Friederich et al. | 312/3 |
| 4,068,906 | 1/1978 | Dur et al. | 403/381 |

FOREIGN PATENT DOCUMENTS

| | | | |
|---|---|---|---|
| 1163524 | 2/1964 | Fed. Rep. of Germany | 52/86 |
| 2201642 | 8/1973 | Fed. Rep. of Germany . | |
| 701339 | 3/1931 | France | 52/86 |
| 1544143 | 10/1968 | France . | |
| 2116795 | 7/1973 | France . | |
| 2410982 | 7/1979 | France . | |
| 495244 | 11/1938 | United Kingdom | 52/86 |
| 683705 | 12/1952 | United Kingdom . | |
| 1356191 | 6/1974 | United Kingdom . | |

*Primary Examiner*—Victor N. Sakran

*Attorney, Agent, or Firm*—Body, Vickers & Daniels

[57] ABSTRACT

There is described a piece of furniture, particularly for stowing goods away, which comprises at least two uprights, two such uprights being fixedly connected to one another, at least one bendable material sheet resiliently opposing such bending, each sheet being retained in the bent condition thereof by two said uprights, as well as at least one horizontal stowing shelf which is supported by bearing means provided on said uprights and/or on the bendable material sheet or sheets. Such pieces of furniture may be used to form a stow-away unit.

18 Claims, 6 Drawing Figures

PIECE OF FURNITURE PARTICULARLY FOR STOWING GOODS AWAY, AND STOW-AWAY UNIT FORMED BY SUCH PIECES OF FURNITURE

This invention relates to a piece of furniture, more particularly for stowing goods away, as well as to a stowaway unit formed by such pieces of furniture.

The object of this invention is to provide pieces of furniture and notably chests with curved walls, which are very easy to assemble and are not clumsy to store and pack.

According to the invention, there is provided a piece of furniture comprising at least two uprights, two such uprights being fixedly connected to one another, at least one bendable material sheet resiliently opposing such bending, each sheet being retained in the bent condition thereof by two said uprights, as well as at least one horizontal stowing shelf which is supported by bearing means provided on said uprights and/or on the bendable material sheet or sheets.

In an advantageous embodiment of the invention, said piece of furniture comprises three uprights and two bendable material sheets, and each bendable material sheet is connected on the one hand, to the one upright from said two fixedly connected uprights and on the other hand, to a third upright in such a way that the resilient biasing forces from both sheets act along diverging directions on said third upright.

In an improved embodiment of the invention, said uprights are each provided with at least one lengthwise slit inside which is clamped the edge of a bendable material sheet.

According to the invention there is further provided a stow-away unit that comprises a plurality of such pieces of furniture connected together by way of module elements. In a particular embodiment of the invention, the edges of two bendable material sheets which are part of two different modular pieces of furniture, are jointly clamped in the one lengthwise slit from one and the same upright.

Other details and features of the invention will stand out from the following description given by way of non limitative example and with reference to the accompanying drawings, in which.

Figure 5:
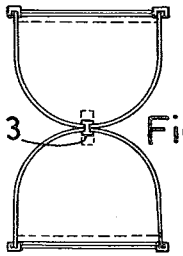
Figure 4:
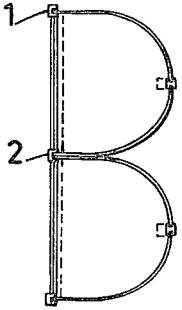

FIGS. 4 and 5 each show a top view from an embodiment of a stow-away unit according to the invention.

Figure 6:
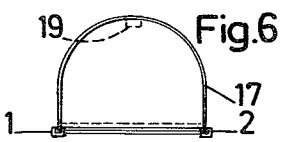

FIG. 6 is a top view of another embodiment of a piece of furniture according to the invention.

In the various figures, the same reference numerals pertain to similar components.

Figure 1:
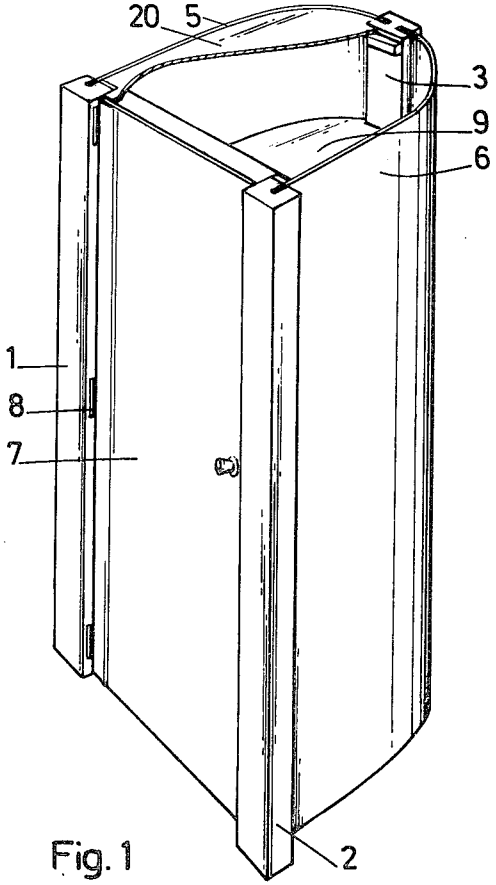
FIG. 1 is a diagrammatic perspective view of an embodiment of a piece of furniture according to the invention.
Figure 2:
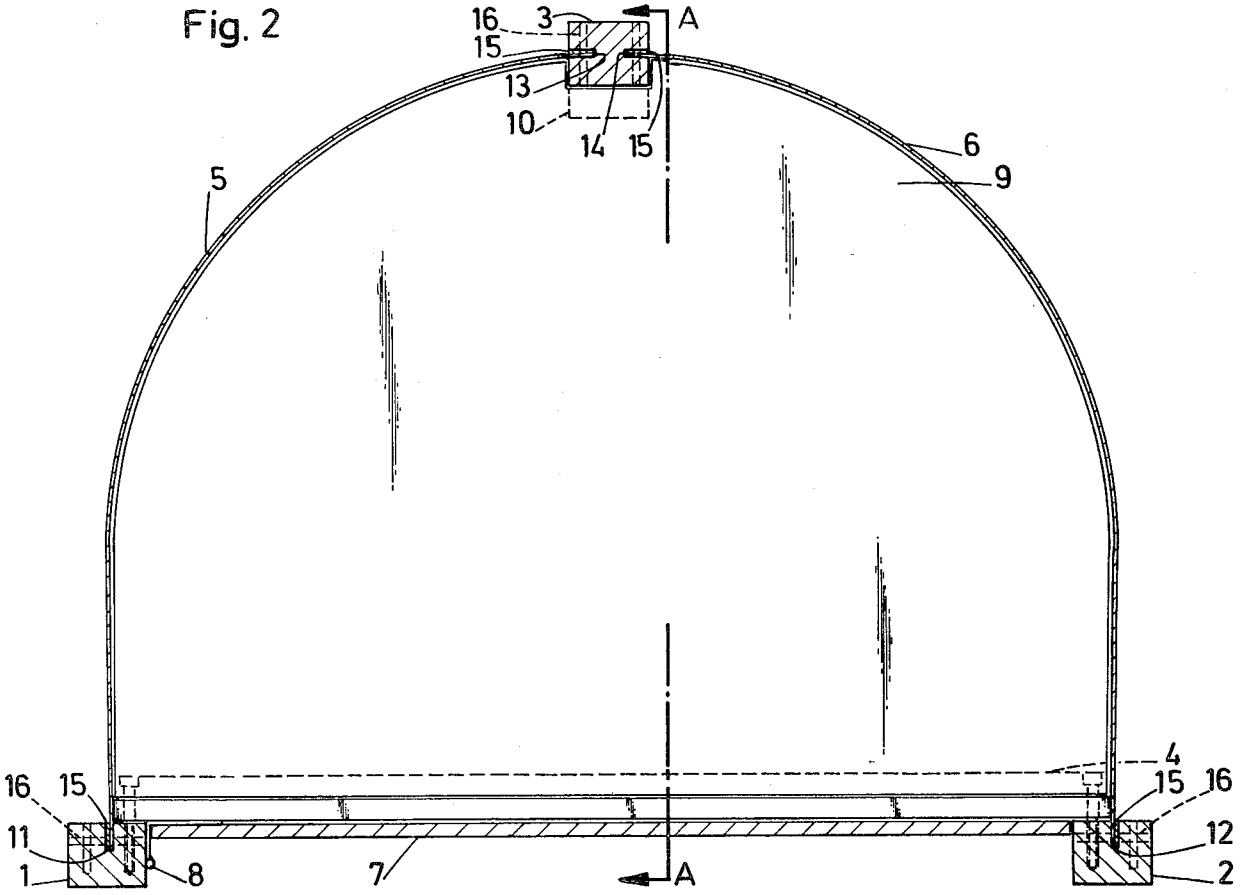
FIG. 2 is a section view along line B—B in FIG. 3, drawn on a larger scale.

The piece of furniture according to the invention as shown in FIG. 1, is a chest-like stow-away piece of furniture which comprises three uprights 1, 2, 3, among which uprights 1 and 2 are fixedly connected together through cross-bars 4 (see FIGS. 2 and 3), as well as two sheets 5 and 6 from a bendable material that resiliently opposes such bending, for example a wood-base material as sold under the trade-marks Triplex, Unalit, etc. Said sheets 5 and 6 are each retained in bent condition, by two uprights 1,3 and 2,3 respectively. The resilient forces biasing said sheets to the original flat position thereof act along diverging directions on said upright 3 and consequently retain same in upright position, said upright being originally separate from both other uprights 1 and 2. Moreover, the retaining of both sheets 5 and 6 in bent condition imparts thereto a better stiffness and gives from the originally flat material, a partly-curved shape to the completed piece of furniture.

Said uprights bear horizontal stowing shelves 9 with a suitable shape which are additionally used to strengthen the panels 5 and 6, said panels or sheets having sometimes a tendency to bend in a way which is not necessarily nice. For this purpose, said shelves have cut-outs which correspond to those locations where the uprights project inwards relative to said shelves. As it appears from FIG. 3, said shelves 9 are supported through cross-bars 4 and bearing elements 10 which are fastened to upright 3 at the same height as said cross-bars 4.

In the chest as shown in FIG. 1, the chest front side lying between uprights 1 and 2, is closed by a closing panel 7 which is swingable on upright 1 by means of hinges 8 (see FIG. 2), and a covering panel 20 supported by the uprights, may be provided to close the opening at the chest top.

To fasten said sheets 5 and 6 to the uprights, those two uprights 1 and 2 which are connected together are each provided with a lengthwise slit 11, 12. Said slits open on the same side relative to that imaginary plane joining both said uprights. Said upright 3 lying on that same side, is provided with two lengthwise slits 13 and 14 opening on two opposite sides thereof, and in the example as shown, said slits are so arranged that after assembly, said sheets 5 and 6 are each bent over a 90°-angle relative to the unconnected position thereof relative to upright 3.

Said slits 11, 12, 13 and 14 are provided with a width which is wider than the thickness of sheets 5 and 6, in such a way as to allow locking same inside the slits by means of clamping shims 15 fitted inside said slits alongside the sheet edges. Moreover retaining means such as trunnions or pins which pass through bores 16 provided therefor in said uprights 1, 2 and 3, the edges of sheets 5 and 6, and the clamping shims 15, retain the sheet edges inside said slits.

In another embodiment of the invention as shown in FIG. 6, there have been provided but two uprights 1 and 2 and a single sheet 17 from bendable material. Said sheet 17 is clamped with both edges thereof inside slits 11 and 12, and it may thus be bent over a 180°-angle relative to the position thereof as connected to a single upright 1 or 2. In such a case, it is moreover required to provide supporting elements 19 which are directly fastened to said sheet 17, to support said shelves 9 in an additional bearing point.

As it appears from the above, the pieces of furniture according to the invention have the advantage that they may be stored and delivered as flat elements and that they may easily be assembled by the owner himself, while obtaining pieces of furniture of curved shape.

Said pieces of furniture may moreover be used as modular components in a stow-away unit some variations of which are shown in FIGS. 4 and 5.

As it appears from FIG. 4, is possible to connect two pieces of furniture according to the invention next to one another, by fitting inside slit 12 for example from upright 2, instead of said clamping shim 15, the lengthwise edge of the sheet from another identical piece of furniture, said upright 2 then being used as upright for both connected modular components.

In the example as shown in FIG. 5, it is possible to connect two pieces of furniture according to the invention, back to back by fitting inside slits 13 and 14 of upright 3, instead of clamping shims 15, the one lengthwise edge from both sheets from another identical piece of furniture, said upright 3 then being used as a common upright for two connected modular components.

It must be understood that the invention is in no way limited to the above embodiments and that many changes may be brought therein without departing from the scope of the invention as defined by the appended claims.

It is notably possible to provide a larger number of uprights and sheets from bendable material, and the fastening means thereof may differ from the ones which have been described.

It is clear that the sheets from bendable material may also be made from other flexible materials, for example from metal materials such as steel sheet, or from a hard flexible synthetic material, for example similar to the material sold under the trade-mark Plexiglas.

It is also possible to consider having the sheets from bendable material not extending over the whole upright length, thus letting an access to various levels of the piece of furniture without having to pass by the front side.

Figure 3:
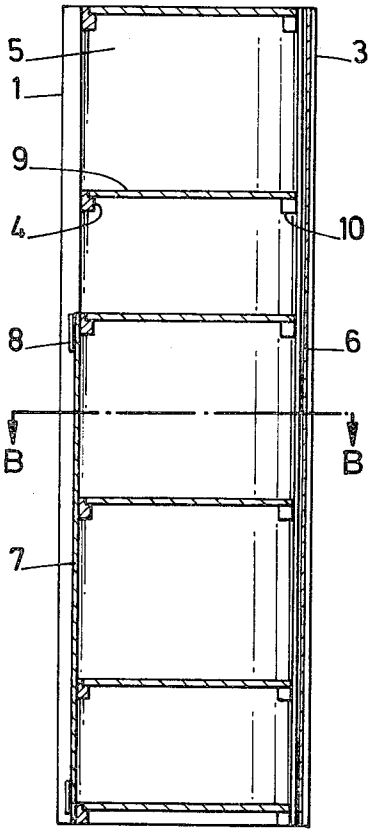
FIG. 3 is a section view along line A—A, drawn on a smaller scale.

It might further be provided that as shown in FIG. 3, the closing panel 7 closes but partly that space lying between uprights 1 and 2, or may even be completely dispensed with.

I claim:

1. An article of furniture comprising, a pair of uprights having upper and lower ends, cross members connecting said pair of uprights in laterally spaced apart relationship, said uprights and cross members providing a vertical unsupported frame for said article of furniture, resilient sheet material wall means having upper and lower edges and opposite side edge means between said upper and lower edges, said sheet material wall means being bent to an arcuate curvature between said side edge means and against the resilient bias of said sheet material, means interconnecting each of said opposite side edge means with a different one of said pair of uprights between said upper and lower ends of said uprights, whereby said uprights and cross members alone maintain said sheet material wall means bent against said resilient bias thereof and said sheet material wall means maintains said frame vertical, at least one horizontal shelf, and bearing means supporting said shelf relative to said uprights and said bent sheet material wall means.

2. An article of furniture according to claim 1, wherein said means interconnecting said opposite side edge means with said pair of uprights includes a slit extending lengthwise in each one of said pair of uprights and receiving the corresponding edge means therein.

3. An article of furniture according to claim 2, wherein said resilient sheet material wall means is a single sheet of material having opposite edges providing said side edge means.

4. An article of furniture according to claim 3, wherein said means interengaging said opposite side edge means with said pair of uprights further includes clamping shims engaging in each said slits against the corresponding one of said opposite side edges.

5. An article of furniture according to claim 4, and retaining pin means extending transversely through said slits and through said sheet side edges and clamping shims in said slits.

6. An article of furniture according to claim 2, wherein said means interengaging said opposite side edge means with said pair of uprights further includes clamping shims engaging in each said slits against the corresponding side edge means therein.

7. An article of furniture according to claim 1, wherein said resilient sheet material wall means is a single sheet of material having opposite said edges providing said side edge means.

8. An article of furniture according to claim 1, wherein said resilient sheet material wall means includes a third upright laterally between and horizontally offset from said pair of uprights and first and second sheets of resilient material each having corresponding laterally outer and inner side edges, said laterally outer side edges providing said opposite side edge means of said sheet material wall means, and means interconnecting each of said laterally inner side edges with said third upright.

9. An article of furniture according to claim 8, wherein said means interconnecting said opposite side edge means with said pair of uprights includes a slit extending lengthwise in each one of said pair of uprights and receiving the corresponding one of said laterally outer side edges of said first and second sheets therein, and said means interconnecting each said laterally inner side edges with said third upright includes a pair of slits extending lengthwise in said third upright and receiving said laterally inner side edges therein.

10. An article of furniture according to claim 9, wherein said means interconnecting said opposite side edge means with said pair of uprights and said laterally inner side edges with said third upright further includes clamping shims engaging in said slits in said pair of uprights and in said pair of slits in the said third upright against the corresponding inner and outer side edges of said first and second sheets in said slit.

11. An article of furniture according to claim 10, and retaining pin means extending transversely through said slits in said pair of uprights and said third upright and through said sheet side edges and clamping shims in said slits.

12. An article of furniture according to claim 1, wherein said sheet material means is a wood base sheet material.

13. An article of furniture according to claim 1, wherein said sheet material means is metal sheet material.

14. An article of furniture according to claim 1, wherein said sheet material means is a synthetic resinous sheet material.

15. An article of furniture according to claim 1, wherein said bearing means supporting said shelf includes a horizontal cross bar between and connected to said pair of uprights.

16. An article of furniture according to claim 15, wherein said resilient sheet material wall means includes a third upright laterally between and horizontally offset from said pair of uprights and first and second sheets of resilient material each having corresponding laterally outer and inner side edges, said laterally outer side edges providing said opposite side edge means of said sheet material wall means, and means interconnecting each of said laterally inner side edges with said third upright, said bearing means supporting said shelf further including a supporting element on said third upright at the same level as said cross bar.

17. An article of furniture according to claim 15, wherein said bearing means further includes supporting elements on said sheet material means at the same level as said cross bar.

18. An article of furniture according to claim 1, and a closure panel between said pair of uprights and diametrically opposite said bent sheet material wall means, said closure panel being hingedly mounted on one of said pair of uprights, and a horizontal top panel spaced above said shelf and supported on said uprights and said wall means.

* * * * *